US009408505B2

(12) United States Patent
Granger

(10) Patent No.: US 9,408,505 B2
(45) Date of Patent: Aug. 9, 2016

(54) APPLIANCE FOR DISTRIBUTING A PRECUT WIPING MATERIAL THAT IS ROLLED UP OR FOLDED IN A Z SHAPE

(76) Inventor: Maurice Granger, Saint Priest en Jarez (FR)

( * ) Notice: Subject to any disclaimer, the term of this patent is extended or adjusted under 35 U.S.C. 154(b) by 299 days.

(21) Appl. No.: 13/879,496

(22) PCT Filed: Oct. 10, 2011

(86) PCT No.: PCT/FR2011/052354

§ 371 (c)(1),
(2), (4) Date: Jun. 12, 2013

(87) PCT Pub. No.: WO2012/052653

PCT Pub. Date: Apr. 26, 2012

(65) Prior Publication Data

US 2013/0256450 A1 Oct. 3, 2013

(30) Foreign Application Priority Data

Oct. 18, 2010 (FR) ..... 10 58449

(51) Int. Cl.

| | |
|---|---|
| ***A47K 10/34*** | (2006.01) |
| *A47K 10/36* | (2006.01) |
| *A47K 10/32* | (2006.01) |

(52) U.S. Cl.

CPC ..... *A47K 10/34* (2013.01); *A47K 10/3656* (2013.01); *A47K 2010/3233* (2013.01); *A47K 2010/3675* (2013.01)

(58) Field of Classification Search

CPC ..... A47K 10/3656; A47K 2010/3233; A47K 2010/3681; A47K 10/36; A47K 10/34; A47K 10/32; A47K 2010/3246; A47K 2010/326; A47K 2010/3675; A47K 10/3687; A47K 10/38; A47K 2010/3881; A47K 10/42; A47K 10/424

USPC ..... 242/596, 596.4, 596.8, 598.5, 598.6, 242/579, 580, 580.1, 566, 615.3

See application file for complete search history.

(56) References Cited

U.S. PATENT DOCUMENTS 2,193,759 A * 3/1940 Birr ..... A47K 10/36 125/11.16
2,273,384 A 2/1942 Steiner et al.

(Continued)

FOREIGN PATENT DOCUMENTS

EP 0 387 160 A1 9/1990
WO 01/30226 A1 5/2001

(Continued)

OTHER PUBLICATIONS

International Search Report for International Application No. PCT/FR2011/052354, dated Oct. 10, 2011.

*Primary Examiner* — Sang Kim
*Assistant Examiner* — Nathaniel Adams
(74) *Attorney, Agent, or Firm* — Heslin Rothenberg Farley & Mesiti P.C.

(57) ABSTRACT

The machine includes a housing receiving an articulated cover closed by raising it and a module which accommodates a pre-cut wound strip of material. The module has a flap located opposite the inner face of the cover and articulated relative to the module, and a device enabling pulling on the end of the strip. The module enables positioning and articulation of the flap, and includes a support plate for the device. The device includes a vertically arranged pusher which slides in a controlled, limited manner relative to a face of the support plate. The pusher has a lower gripping and contact part and an upper end that forms a cam. A roller of the device cooperates with the upper end of the pusher. The pusher cooperates with the flap. The device acts on the flap to ensure its rearward swivelling to allow un-jamming and strip emergence from the machine.

10 Claims, 7 Drawing Sheets

(56) References Cited

Figure 1:
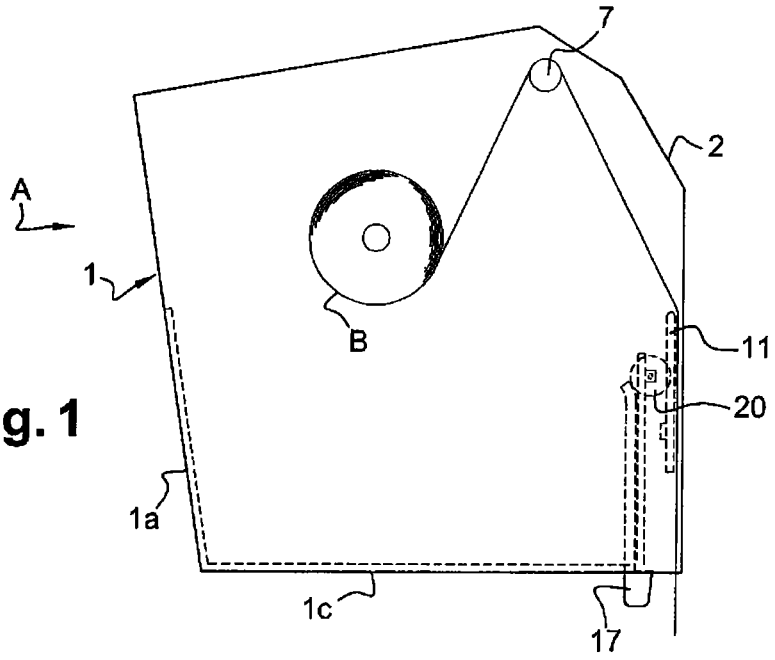

U.S. PATENT DOCUMENTS 4,165,138 A * 8/1979 Hedge ..... A47K 10/3687 242/560
4,317,547 A * 3/1982 Graham, Jr. ..... A47K 10/3687 242/560.1
4,699,304 A * 10/1987 Voss et al. ..... 226/129
4,846,412 A * 7/1989 Morand ..... 242/560.1
5,207,633 A * 5/1993 Granger ..... 493/357
5,335,811 A * 8/1994 Morand ..... 221/45
5,979,822 A * 11/1999 Morand et al. ..... 242/564.2
6,112,631 A * 9/2000 VanAlstine ..... 242/564.1
2011/0284681 A1 * 11/2011 Granger ..... A47K 10/34 242/580

FOREIGN PATENT DOCUMENTS

WO 2009/150342 A2 12/2009
WO 2010/089467 A1 8/2010

* cited by examiner

Fig. 5
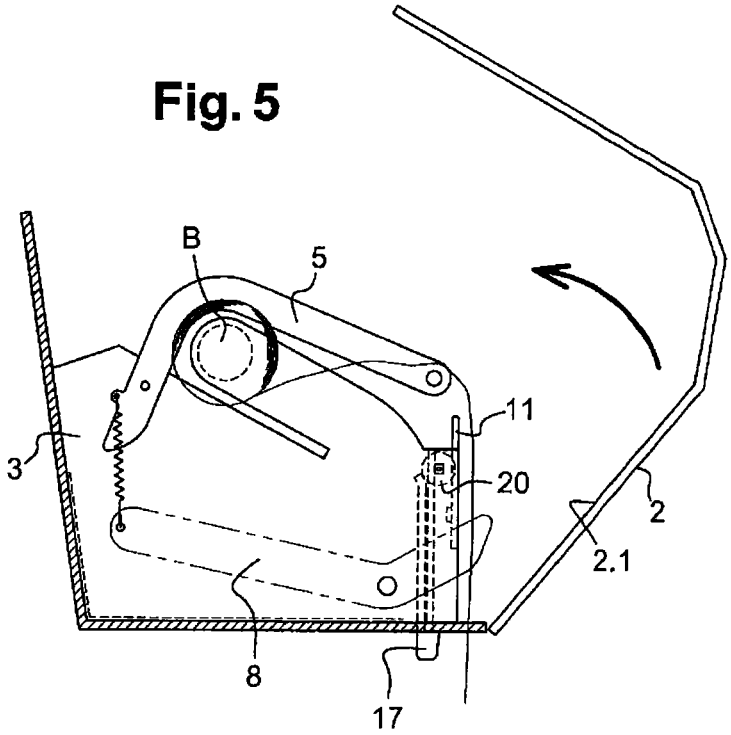
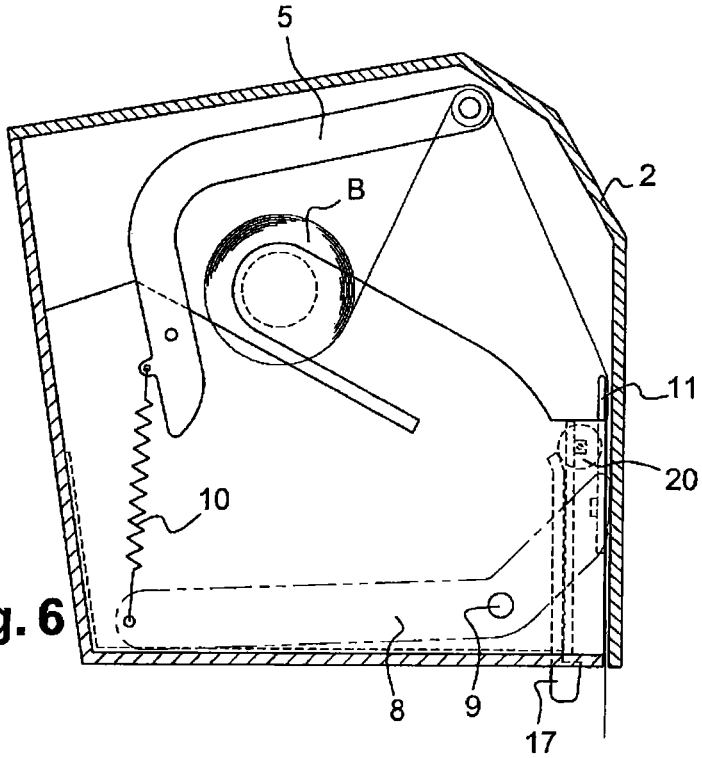
Fig. 6

APPLIANCE FOR DISTRIBUTING A PRECUT WIPING MATERIAL THAT IS ROLLED UP OR FOLDED IN A Z SHAPE

CROSS REFERENCE TO RELATED APPLICATIONS

This application is a national stage filing under section 371 of International Application No. PCT/FR2011/052354, filed on Oct. 10, 2011, and published in French on Apr. 26, 2012, as WO 2012/052653 and claims priority of French application No. FR 1058449 filed on Oct. 18, 2010, the entire disclosure of these applications being hereby incorporated herein by reference.

BACKGROUND ART

The invention relates to the technical field of dispensing machines for wipe materials of the wadding paper type for hand wipe, toilet paper and general-purpose wiping and cleaning applications.

The wipe material may be presented in various configurations which have all been the subject of design work and research carried out by the Applicant who has specialised in dispensing machine technology for roughly 40 years and has filed a very large number of patents.

The wipe material may be wound on a reel and be dispensed by dispensing machines which include a cutting device with automatic or semi-automatic operation. These machines make it possible to use a cutting device located in a drum to cut materials to a predetermined format.

The wipe material may be accordion-pleated by a special-purpose mechanism with a built-in cutting device. An example of this is described in Patent EP 387160.

The wipe material can be pre-cut and, in this case, it is accordion pleated in successive folds. In this configuration, the volume of the material to be dispensed remains compact and, in every case, there is no comparison with a strip of material wound on a reel.

The problem to be resolved by the Applicant is to design a dispensing machine for pre-cut wipe materials wound on a reel.

As far as the Applicant is aware, there is no dispensing machine which meets this criterion. Various attempts to design such a machine have been made but have eventually been abandoned due to major unresolved problems relating to the random nature of the pulling force exerted on the material by the user, the direction of this force and the risks of jamming due to material becoming blocked in the machine. The fact that the wipe material is pre-cut makes it legitimate to question whether there is any need for there to be a cutting device at all. The problem to be resolved then becomes mainly the fact that the wipe material is grasped and removed by users exerting highly variable pulling forces in highly variable directions which interfere with cutting of the strip of material inside the machine and therefore cause malfunctioning. During maintenance, the dispensing machine then has to be reopened and refilled appropriately, i.e. a strip of material has to be left emerging from the machine so that it can be grasped. This is the major difficulty which has prevented the dispensing of pre-cut wipe material wound on a reel.

Having defined the problem to be solved, the Applicant then carried out work and conducted various design studies with the aim of reliably and continuously meeting the need to dispense pre-cut wipe material wound on a reel.

In the context of all this work and research on wipe material dispensing machines in general, the Applicant has developed the concept of a compensating lever which is articulated relative to the housing of the machine, enabling it to act on the strip of material and retract towards the rear of the machine by swiveling through an angle which is proportional to the pulling force in order to create a shock absorbing device. This makes it possible to prevent excessive tensioning of the material, thus avoiding inopportune breaking of the strip of material. This is described in Patent EP 387160.

The Applicant also devised and perfected, in Patent PCT WO 01/30226, the possibility of a pressure roller capable of being elastically pressed against a drum which accommodates a cutting device through the intermediary of two independently articulated levers which make it possible to follow unwinding of the strip of material as a function of the orientation of the pulling force relative to the dispensing machine. In this case, the two levers are structurally identical and attached relative to the side pieces of the housing of the machine and their other end is connected to the pressure roller. It is therefore possible for the two levers to "wiggle" in order to follow and absorb the effects of the wipe material being pulled.

Building on the facts disclosed in these two patents, the Applicant therefore tried to incorporate this solution in a machine for dispensing pre-cut wipe material.

In practice, transferring the knowledge disclosed in these two solutions does not make it possible to ensure reliable operation and dispensing because the Applicant observed jamming of the mechanisms in question.

Building on these documents, the Applicant's approach was therefore to look for a reliable solution, taking into account the environment of the dispensing machine without a cutting device and therefore without a drum against which the strip of material is pressed, in particular in Patent WO 01/30226.

One solution devised by the Applicant is described in Patent Application PCT FR 2009052161 which is defined by the following aspects:

The machine for dispensing wipe material wound on a reel described in this document comprises a wall-mounted housing with a back panel, two lateral panels, a lower base panel and a cover that is articulated relative to said housing and that can be lifted upwards, said back panel accommodating a module which itself has a back panel and two shaped lateral side pieces designed to accommodate the reel of material. The dispensing machine according to the invention comprises a compensating-lever mechanism which is intended to move the pre-cut strip of material back towards the rear of the machine and do so in close combination with lifting or lowering of the cover. This compensating-lever mechanism is externally located either side of the lateral side pieces of the module in the space formed with the lateral side pieces of the housing. The mechanism thus comprises two levers which are articulated relative to each other and between which there is at least one return roller. The first lever has a uniform structure and the second lever is designed with various components which enable Cardan-joint type articulation. The levers are coupled to the arms that are used to raise or lower the cover.

Although the operation of the machine described in Patent PCT FR 2009/052161 is particularly reliable, the machine nevertheless has certain drawbacks due to its high component count and its therefore considerable manufacturing and assembly costs. In addition, the need to lift the cover in order to allow loading of the reel of material is a nuisance even though it can be locked in its raised position. In fact, the operator's movements are obstructed as he grasps and secures the partially finished reel of material that is to be removed and as he reloads the machine with another reel. Moreover, there is no possibility of the user intervening if wipe material jams.

The Applicant has also developed wipe material dispensing machines described in its Patents WO 2009/150342 and WO 2010/089467.

BRIEF SUMMARY OF THE INVENTION

The Applicant's approach, while retaining the technical concept of the machine described in this patent, was to simplify said machine by allowing it to be opened from the bottom of the cover and also allowing effective intervention if cut material emerging from the machine becomes jammed. The Applicant devised a new solution which is cheaper to implement, makes it possible to position the replacement reel of material in the swiveled cover and, conversely, position the exhausted reel of material after substituting the replacement reel. Another aspect and object of the invention was to facilitate and enable the user to intervene quickly in the event of material jamming inside the machine.

Another object of the invention was to allow the dispensing of a pre-cut strip of material wound on a reel or accordion pleated.

These objects and others will become apparent from the following description.

According to a first aspect of the invention, the dispensing machine for pre-cut wipe material wound on a reel or accordion pleated of the type comprising a housing that receives an articulated cover which can be closed by raising it, said housing accommodating a module that is demountably fixed relative to said housing, said module being designed to accommodate a pre-cut strip of material wound on a reel or accordion pleated, said machine comprising a compensating-lever mechanism intended to move the pre-cut strip of material back towards the rear of the machine when said cover is raised, said mechanism being externally located either side of the lateral side pieces of the module, is distinctive in that the module comprises a flap which is articulated relative to the module and a device that makes it possible to pull the end of the strip of material in the event of a jam or abnormal transport of the strip of material between the flap and the inner face of the cover, said module being designed with and comprising means to enable positioning and articulation of a flap located opposite the inner face of the cover and in that said module comprises a support plate for said device, and in that the device comprises a vertically arranged pusher that slides in a controlled manner which is limited relative to the inner face of the support plate, and in that the pusher has a lower contact and gripping part and an upper end forming a cam, and in that the device comprises a means of rolling mounted on a shaft relative to the support plate, and in that the means of rolling is capable of cooperating with the upper end of the pusher, and in that the pusher is capable of cooperating with a flap, and in that the device acts on the flap in order to ensure its swivels backwards and enlarges the space between the flap and said inner wall of the cover in order to allow unjamming and allow the strip of material to emerge from the machine.

These aspects and others will become apparent from the rest of the description.

BRIEF DESCRIPTION OF THE DRAWING FIGURES

Figure 2:
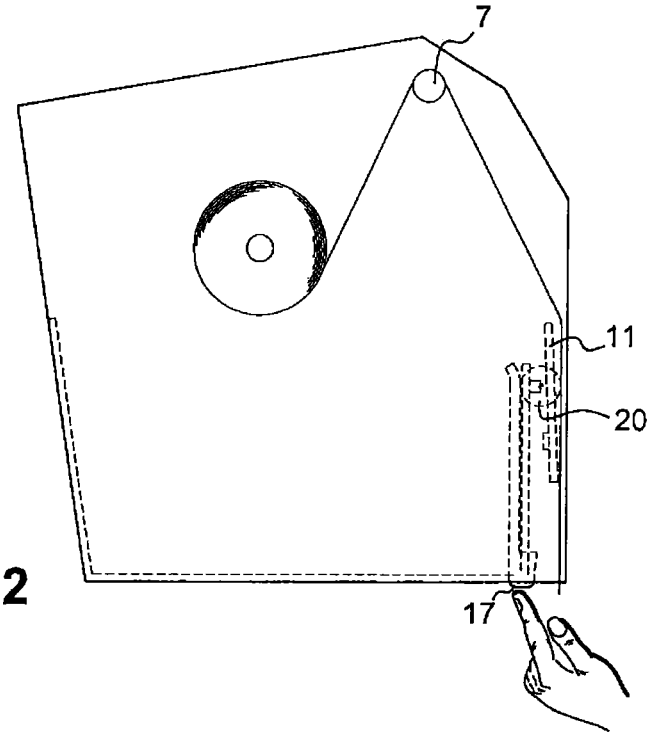
Figure 3:
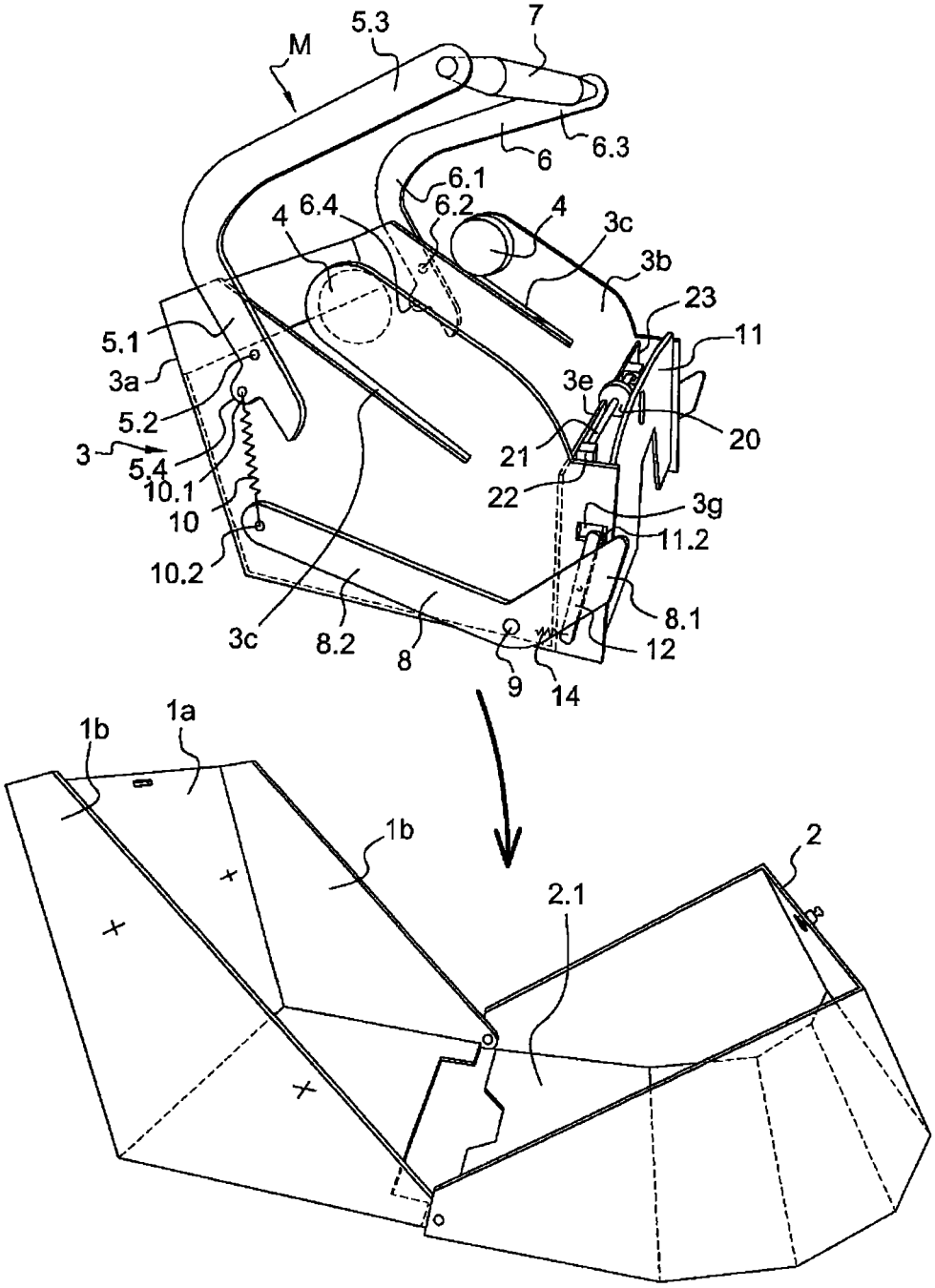
Figure 4:
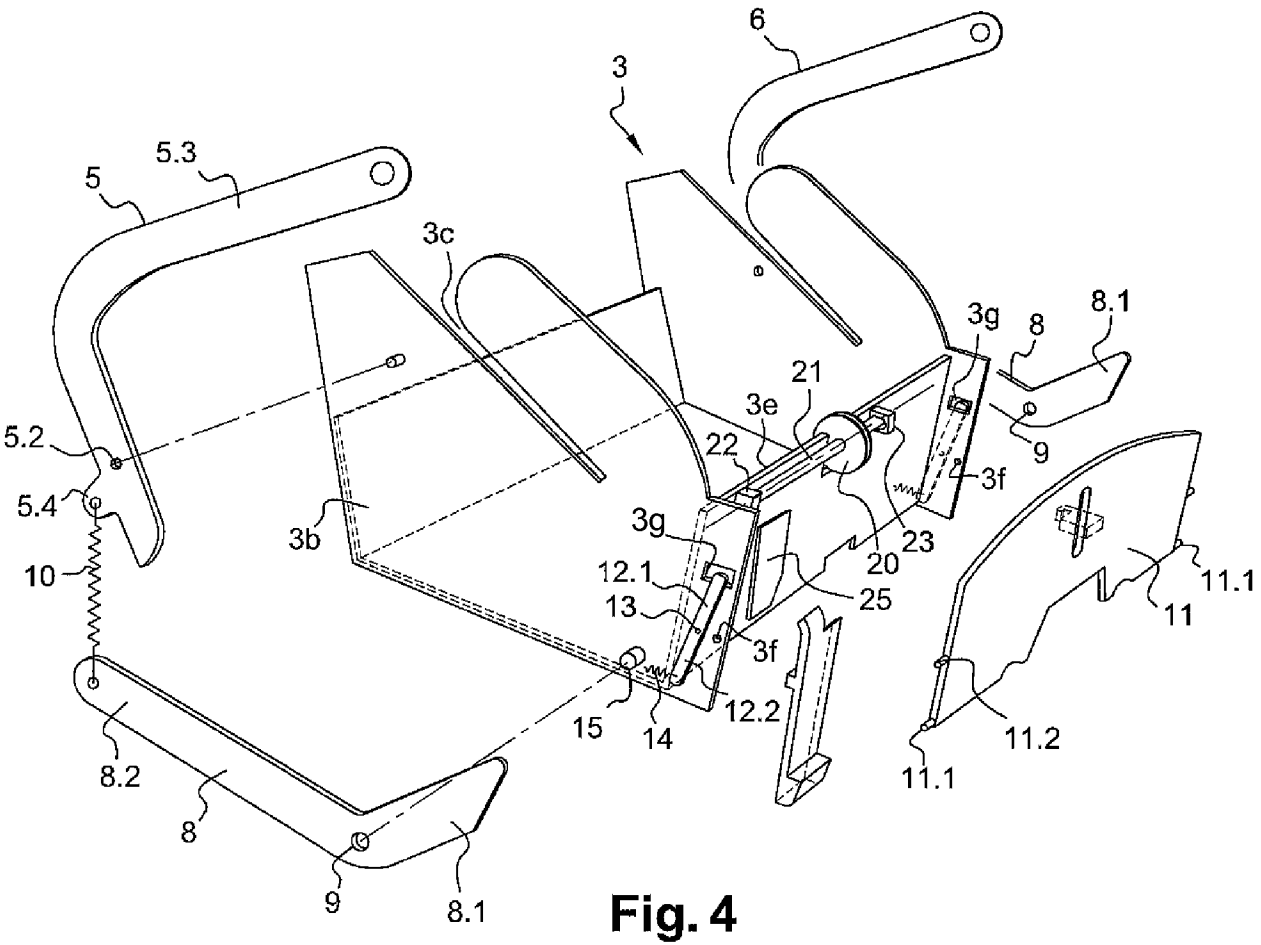
Figure 7:
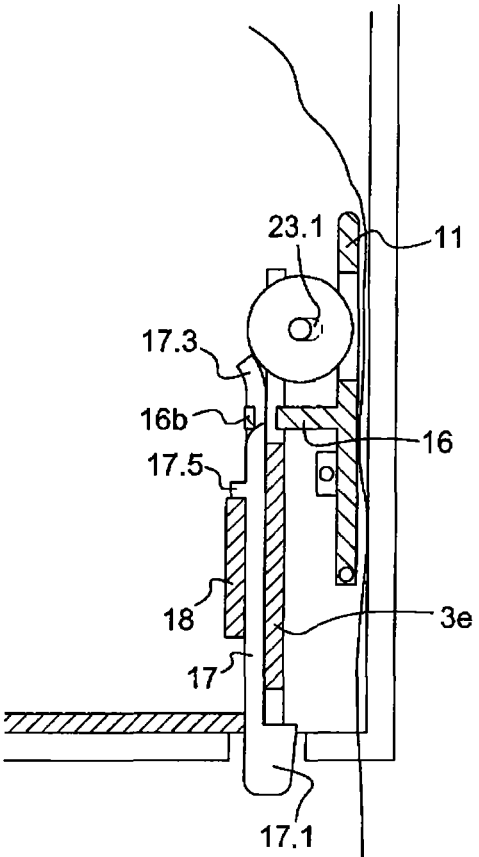
Figure 8:
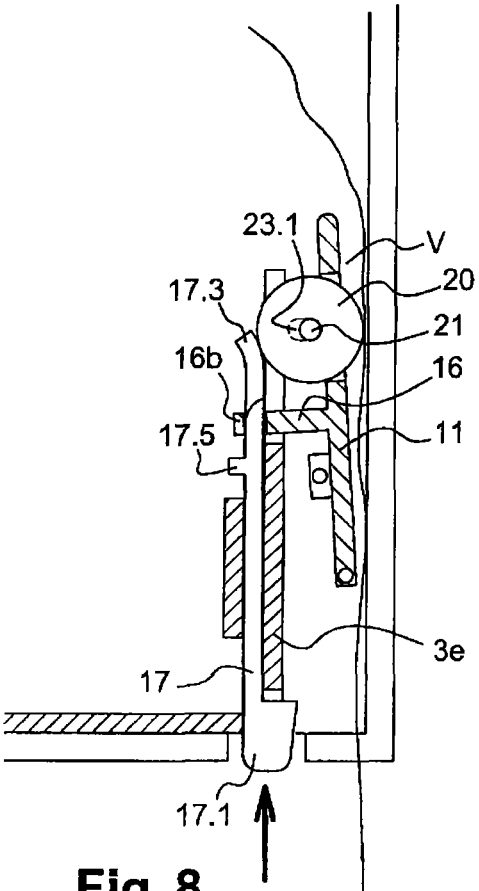
Figure 9:
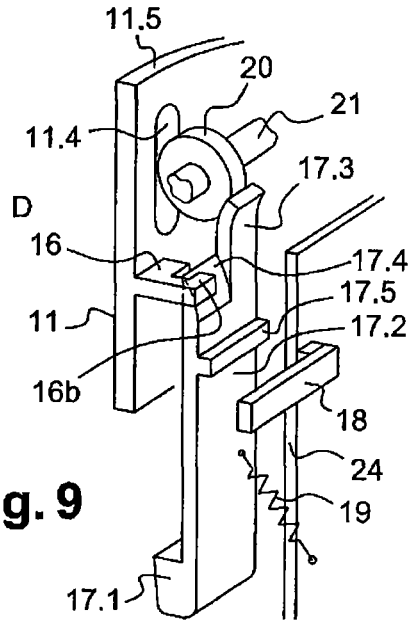
Figure 10:
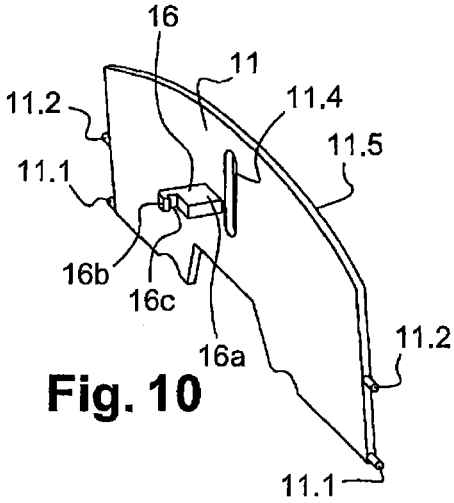
Figure 11:
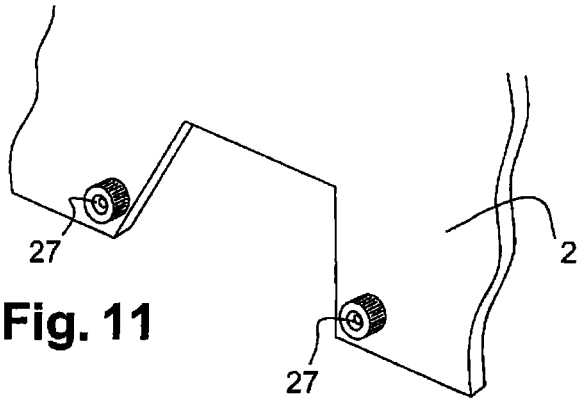
Figure 12:
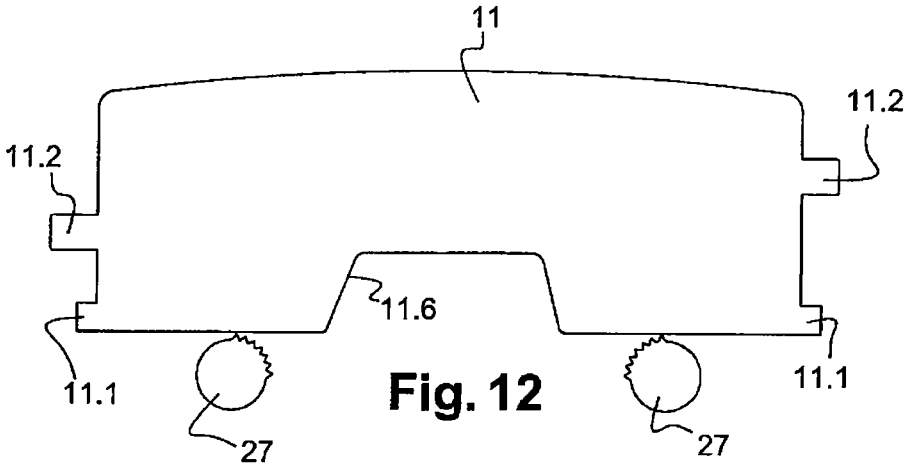
Figure 13:
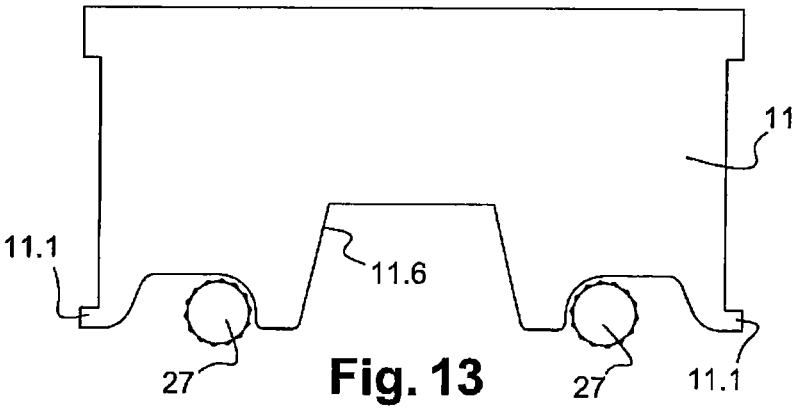
Figure 14:
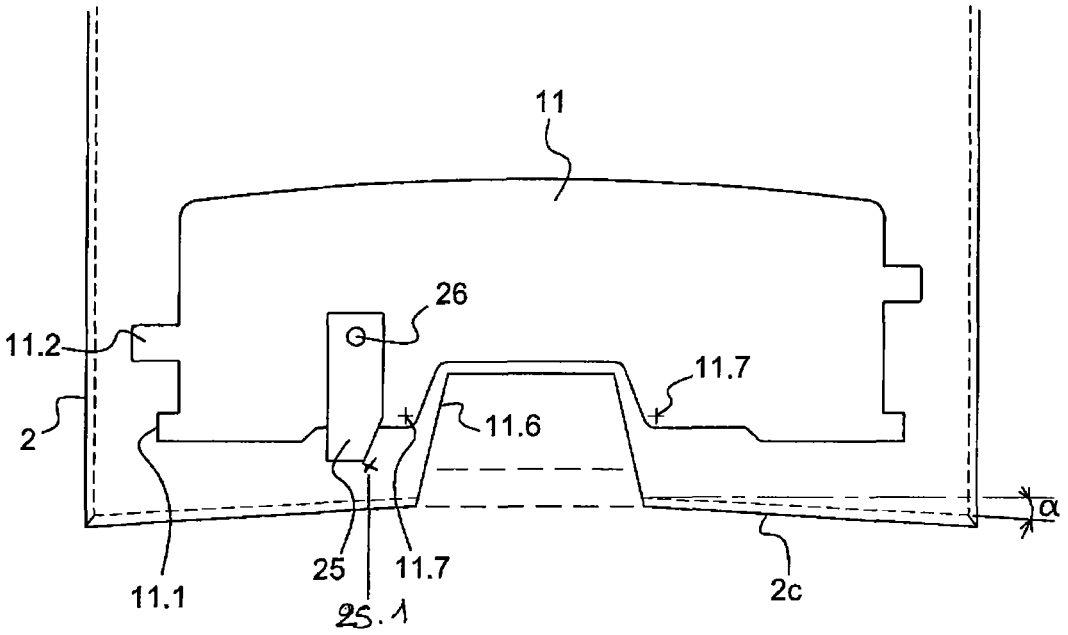
Figure 15:
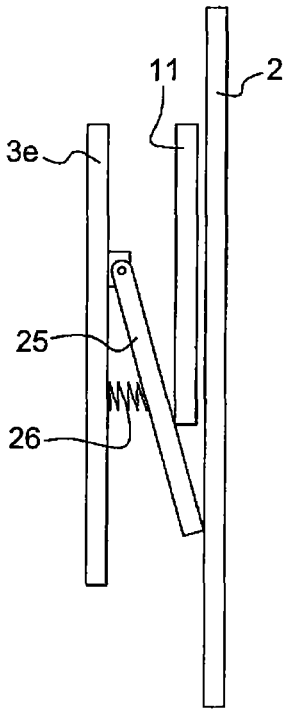

The object of the present invention is described, merely by way of example, in the accompanying drawings in which:

FIGS. 1 and 2 are schematic views illustrating the operation of the machine, FIG. 3 is a perspective view, before assembly, of the dispensing machine comprising a module designed according to the invention and placed in a housing with a downward swiveling cover, FIG. 4 is an exploded, schematic, perspective view of the module before assembly of its components, FIGS. 5 and 6 are side views of the machine shown in FIG. 3 with the module placed in the housing before closing the cover and after closing the cover, FIGS. 7 and 8 are schematic cross-sectional views showing actuation of the device for unjamming the strip of material, FIG. 9 is a partial perspective view showing the unjamming device, FIG. 10 is a partial rear view of the flap, FIG. 11 is a partial view of the cover, including the means of separating individual pieces of material and guiding the strip of material out of the machine, FIG. 12 is a view that supplements FIG. 11 and schematically shows the flap and the means located on the cover in order to eject the strip of material and separate individual pieces FIG. 13 is an alternative view of the flap in FIG. 12, FIG. 14 is an alternative view showing emergence of the strip of material in a flat configuration and the slat for separating individual pieces, FIG. 15 is a schematic view showing the means depicted in FIG. 14.

DETAILED DESCRIPTION

In order that the object of the invention may more readily be understood, the following description is given, merely by way of example, reference being made to the accompanying drawings.

The dispensing machine for pre-cut wipe material is represented in its entirety as (A) and comprises a wall-mounted housing (1) with a back panel (1*a*), two side panels (1*b*), a lower base panel (1*c*) and a cover (2) which is articulated relative to the housing so that it can be closed by lifting it upwards and locking it. The housing is capable of receiving a module (3) which itself has a back panel (3*a*) and two lateral side pieces (3*b*) shaped and designed in a known manner in order to receive reel (B) of pre-cut wipe material. The reel of material is held by end pieces (4) or convex shapes on the lateral side pieces (3*b*) of the module with at least one of the side pieces or parts of the side pieces having the capacity of elastic deformation in a known manner in order to make it possible to position the reel of material. A slit (3*c*) can be made in each of the side pieces in order to impart this elasticity. Alternatively, the pre-cut strip of material can be accordion pleated and the corresponding pack can be placed behind the module.

The module is fixed to the housing by quick-release click-in means of a known type so that it can be mounted and removed as required.

The dispensing machine according to the invention is designed to accommodate a compensating-lever mechanism referred to in its entirety as (M) which is intended to move the reel of pre-cut strip of material back towards the rear of the machine and do so in close combination with lifting or lowering of the cover. This mechanism (M) is externally located either side of the lateral side pieces of the module in the space formed with the lateral side pieces (1*b*) of the housing.

This compensating-lever mechanism comprises two angled 'L'-shaped levers (5) and (6) with one of their respective arms (5.1) (6.1) being articulated relative to the side pieces (3*b*) of the module by pivot axes (5.2) (6.2). These two levers are arranged parallel and independently of each other, but the upper ends of their arms (5.3) (6.3) are linked by a spacer bar (7) which is freely mounted and constitutes a return roller against which the strip of material obtained from the reel of material will be pressed and guided. The lower parts of levers (5) and (6) each have a means of attachment (5.4) (6.4) which is used to attach an elastic return means (10) in the form of a spring. One end of this spring (10.1) is attached to corresponding lever (5-6) and its other end (10.2) is attached to a bent transmission arm (8) which is itself articulated relative to the side pieces (3*b*) of the module. This 'L'-shaped bent transmission arm (8) has a shaped front end (8.1) which protrudes relative to the fore-plane of module (3) in order to cooperate with the cover (2). The rear end (8.2) of each transmission arm is used to attach the second end (10.2) of return means (10). This transmission arm is itself articulated relative to a shaft (9) which is attached to side pieces (3.*b*). In this embodiment, any action of raising the cover of the machine causes the cover to come into contact with the two above-mentioned transmission arms (8) either side of the module and allows said arms to swivel upwards. The rear ends of the arms then swivel downwards due to this effect and this causes lifting of the compensating-lever mechanism (M). Spacer bar (7) provides a connection between the transmission arms and allows the arms to be articulated relative to each other in order to make it possible to absorb movements when the strip of material is pulled by the user.

According to the invention, module (3) is designed to allow positioning and articulation of a flap (11) capable of being located opposite the inner face of cover (2) with a limited ability to swivel. According to the invention, module (3) is designed with a device (D) which makes it possible to pull on the end of the strip of material when there is a jam or abnormal transport of the strip of material between above-mentioned flap (11) and cover (2). Together, these features combine to help dispense the strip of material and eliminate jamming or blocking of the material in the space (V) defined between said flap and said inner wall (2.1) of cover (2).

More specifically, the embodiment is as follows: the front part of the module, between its lateral side pieces (3*b*), has a support plate (3*e*) that makes the module rigid and is substantially retracted relative to the forward ends of said side pieces (3*b*). This support plate accommodates device (D). It is perpendicular to the base panel (3*d*) of the module and is vertical or substantially vertical.

Flap (11) is in front of this support plate. The base of the flap is articulated by two pivot axles (11.1) which penetrate into openings (3*f*) forming recesses made in the thickness of side pieces (3*b*). The flap has, substantially above each of its pivot axis, transversely-arranged projecting tabs (11.2) which are capable of passing through windows (3*g*) formed close to the ends of side pieces (3*b*). The upper part of flap (11) has a vertical oblong opening (11.4) capable of allowing one of the means that constitute device (D) to pass through it. The upper edge (11.5) of said flap has a curved, upwardly domed configuration to allow movement and transport of the strip of material.

Flap (11) has the ability to angularly swivel rearwards on its pivot axes relative to the support plate. To achieve this, on the outer faces of lateral side pieces (3*b*) of the module, there is a lever (12) which is articulated by its median point relative to a swivel point (13) attached to each of the lateral side pieces. Each lever has an upper end (12.1) capable of being in contact with the opposite-facing, protruding transverse tab (11.2) on the flap which passes through side piece (3*b*). The opposite end (12.2) of each arm is attached to a spring (14), the other end of which is attached to an attachment point (15) located on the rear of each of the lateral side pieces. Rearward swiveling of flap (11) is therefore opposed by the extension of each of the springs (14).

According to another aspect of the invention, flap (11) has, on its inner plane, a stub (16) which is horizontally shaped (16*a*) and whose tip extends as a hook shape (16*b*). The function of this stub is explained below.

Device (D) is described below.

This device (D) comprises a vertically arranged pusher (17) which slides in a controlled, limited manner relative to the inner face of support plate (3*e*). This vertically arranged pusher is capable of being actuated by the user under conditions that are stated below. It comprises a lower contact and gripping part (17.1) which is visible in the lower part of the machine so that it can be manipulated by the user. Its upper end (17.2) has a twin opposing-slope shape (17.3) (17.4) which forms a cam. Support plate (3*e*) is designed with a protruding shape (18) constituting a guide which can be integrally moulded with it, leaving room for the pusher to move when it is actuated. The upper part of the pusher has a rib (17.5) which is capable of pressing against guide part (18) in order to limit downward travel of the pusher. Elastic return means (19) is attached by its ends (19.1) to the base of the module and also to the body of the actual pusher.

According to another aspect, the end of the pusher is designed with twin opposite-sloping surfaces, (17.3) (17.4) respectively. Also, device (D) comprises a means of rolling (20) in the form of a roller mounted on the outer face of support plate (3*e*). This roller is mounted on a shaft (21) so that it is located forward of said support plate. This roller is positioned so that it is opposite the upper end of the pusher and, more especially, its sloping surface (17.3). In a very particular manner, shaft (21) is mounted between two end fittings (22) (23) which protrude relative to support plate (3*e*). The first end fitting (22) is used to position the shaft in a fixed manner and integrate, in its internal space, a means of the free wheel type which allows shaft (21) to rotate in one direction only. The other end fitting (23) is designed with an oblong opening (23.1) which allows slight lateral deflection of shaft (21), thereby enabling the position of roller (20) to be modified under operating conditions that are described below.

According to another aspect of the invention, the hook part (16*b*) formed on stub (16) of flap (11) also has a sloping surface (16*c*) which is intended to come into contact with the second sloping surface (17.4) on the upper end of the pusher (17). A window (24) in the thickness of the support plate allows movement of the hook-shaped end (16*b*) so that the respective sloping surfaces (16*c*) and (17.4) come up against and in contact with each other in order for the device to operate.

The operation of the machine is explained below, making reference to the drawings.

In the machine's normal operating state, cover (2) is raised upwards after loading the reel of pre-cut material and the cover is locked by an appropriate mechanism which is not shown. Raising the cover causes its inner face (2.1) to press against the end of transmission arms (8) which, in turn, by swivelling, cause lifting of compensating-lever mechanism (M). In this situation, the strip of material passes around return roller (7) of the compensating-lever mechanism in front of flap (11), between the latter and inner wall (2.1) of cover (2) so that it can then be grasped by the user. In this situation, flap (11) is in its forward position relative to module (3) and roller (20) of device (D) does not protrude beyond said flap. The space (V) through which the strip of material passes (between the flap and the cover) is therefore limited.

If the strip of material happens to jam in the area of the space between the flap and cover or if there is any abnormal operation, the user cannot grasp the end of the strip of material in order to tear off a piece of material. It is therefore necessary to implement combined dual movement of device (D) and flap (11) in order to free up the space where the jam is located in order to fix it, thereby making the strip of material available again as it emerges from the machine.

The user can operate pusher (17) by vertically raising it in order to achieve this. This action causes a dual movement, namely contact between the upper end (17.2) of the pusher and roller (20) and, because of the way the corresponding cam with a sloping surface (17.3) is shaped, this causes forward movement of the roller. The shaft (21) of said roller is therefore substantially moved in the oblong recess (23.1) formed in end fitting (23) and this allows movement of the roller in opposite-facing oblong slot (11.4) in the flap.

Also, raising pusher (17) causes the hook part (16*b*) of the stub (16) associated with the flap to come into contact with the second sloping surface (17.4) formed on the upper end of the pusher. This causes rearward swivelling of the flap which increases the extent to which roller (20) protrudes. The roller comes into contact with the cover and the strip of material is transported downwards; releasing the pusher in opposition to elastic means (19) which is associated with it causes retraction of the roller which then no longer touches the strip of material. Several successive to-and-fro actions on the pusher make it possible to gradually advance the strip of material until it can be grasped by the user. Because the space between the flap and opposite-facing inner wall (2.1) of the cover has been made larger, it is easier to unjam the strip of material.

The device described is extremely practical and it can be manipulated easily by the user in complete safety.

According to another aspect of the invention, the machine is configured to enable dispensing of a flat or slightly crumpled strip of material.

Depending on the configuration of the strip of material (flat or slightly crumpled), the layouts shown in FIGS. 11 to 14 are provided.

With a flat configuration (FIG. 14), flap (11) has a central cut-out (11.6) through which the strip of material passes with protrusions (11.7) which are capable of coming into contact with the actual material. The lower part of at least one backing plate (25), which is articulated relative to support plate (3*e*) in opposition to an elastic means (26), protrudes beyond the end of the flap, thereby constituting a second pressure point (25.1) on the strip of material. On its front surface, the actual cover has a curved panel (2*c*) which is inwardly oriented so as to cooperate with said backing plate (25) and the end of flap (11) by two pressure points (11.7) and (25.1). There is therefore intimate contact with the strip of material in order to separate individual pieces.

In the embodiment in FIGS. 11 to 13 which correspond to a slightly crumpled configuration, toothed rollers (27) ensure the separation of pre-cut pieces.

The advantages of the invention are readily apparent. The simplicity of the mechanisms, the limited number of components and the possibility of straightforward action by the user in order to fix material jams are emphasised.

The pre-cut strip of material can be presented on a reel or be accordion pleated without modifying the concept of the invention or the mechanism which is used. Modules (3) can be adapted depending whether a strip of material wound on a reel or accordion pleated is dispensed, so one can have two slightly different modules used to position the pre-cut strip of material which are designed identically to accommodate the mechanisms and the device according to the invention.

The invention claimed is:

1. A dispensing machine for pre-cut wipe material wound on a reel or accordion pleated, comprising:

a housing having two side panels, a lower base panel, and an articulated cover which is closed by raising the cover, a module demountably fixed within said housing, said module accommodating a pre-cut strip of material wound on a reel or accordion pleated, said module having lateral side pieces, and a support plate at a front of the module, a compensating-lever mechanism adapted to move the pre-cut strip of material back towards a rear of the dispensing machine automatically in response to raising said cover, said compensating-lever mechanism including components located between each lateral side piece of the module and an opposing side panel of the housing, a generally planar flap located between the support plate and the cover and articulately mounted to the module, and a device that makes it possible to pull an end of the strip of material in the event of a jam of the strip of material between the flap and the cover, wherein:

the device comprises a pusher having a longitudinal axis arranged vertically and slides vertically in a controlled and limited manner against an inner face of the support plate, the pusher having a lower contact and gripping part and an upper end forming a cam provided with a sloping surface, the device further comprises a roller mounted on a shaft, the shaft being mounted on the support plate, the cam at the upper end of the pusher contacting the roller to selectively extend at least a portion of the roller through an opening in the flap and into contact with the strip of material, and the device acts on the flap causing the flap to swivel backwards and enlarges a space between the flap and said cover in order to allow unjamming and allow the strip of material to emerge from the dispensing machine.

2. The dispensing machine as claimed in claim 1, wherein:

said flap has an oblong opening allowing at least the portion of the roller to pass through the opening, and a stub having a hook part, the upper end of the pusher has a first sloping surface which forms the cam, and a second sloping surface, and the hook part of the stub of the flap contacts the second sloping surface of the pusher causing the backwards swivel of the flap.

3. The dispensing machine as claimed in claim 2, wherein the flap has pivot axles which cooperate with openings in the lateral side pieces of the module.

4. The dispensing machine as claimed in claim 2, wherein the support plate is located between the lateral side pieces of the module, and has an opening to accommodate movement of the hook part in order to allow rearward displacement of the flap.

5. The dispensing machine as claimed in claim 1, wherein the shaft mounting the roller is mounted between two end fittings which protrude from the support plate, a first of the end fittings positions the shaft in a fixed manner, and a second of the end fittings has an oblong opening which allows slight lateral deflection of the shaft.

6. The dispensing machine as claimed in claim 1, wherein the support plate has a protruding shape forming a guide, the upper part of the pusher has a rib which when pressed against the protruding shape limits travel of the pusher, and an elastic return means attached to the pusher and the module controls and limits movement of the pusher.

7. The dispensing machine as claimed in claim 1, wherein the compensating-lever mechanism comprises two 'L'-shaped levers each articulated to a respective lateral side piece of the module by a pivot axle, said 'L'-shaped levers being arranged parallel and independently of each other, with upper parts linked by a spacer bar which constitutes a return roller for the strip of material, and each lever is linked by an elastic means to a transmission arm articulately mounted to the respective lateral side piece of the module, and a forward end of each transmission arm cooperates with the cover which, when the cover is closed, ensures that the compensating-lever mechanism is located in a raised position.

8. The dispensing machine as claimed in claim 2, wherein the flap has tabs which pass through a thickness of the lateral side pieces of the module and cooperate with a lever articulated in opposition to elastic means, and the flap swivels rearwards in opposition to extension of the elastic means.

9. The dispensing machine as claimed in claim 1, wherein the flap has a central cut-out through which the strip of material can pass and protrusions located at a lower end of the flap, the dispensing machine further comprising a backing plate articulately mounted to the support plate and an elastic return means mounted between the support plate and the backing plate, with a lower part of the backing plate protruding beyond a lower end of the flap, so that the flap and the backing plate constitute two pressure means for pressing the strip of material, and a front surface of the cover has a curved panel inwardly oriented so as to cooperate with the backing plate and the protrusions formed on the flap when the strip of material moves in order to separate individual pieces of material.

10. The dispensing machine as claimed in claim 1, wherein the flap has a central cut-out through which the strip of material can pass, and the cover has two partially toothed guides located facing the central cut-out.

* * * * *